United States Patent [19]

Terzian

[11] 4,264,966

[45] Apr. 28, 1981

[54] BALANCED DIGITAL TIME DISPLAYS

[76] Inventor: Berj A. Terzian, 66 Hirst Rd., Briarcliff Manor, N.Y. 10510

[21] Appl. No.: 53,402

[22] Filed: Jun. 29, 1979

Related U.S. Application Data

[63] Continuation-in-part of Ser. No. 861,115, Dec. 16, 1977, abandoned.

[51] Int. Cl.[3] ..... G04C 19/00

[52] U.S. Cl. ..... 368/82; 368/239; 340/756

[58] Field of Search ..... 368/82–84, 368/239–242; 340/765, 756

[56] References Cited

U.S. PATENT DOCUMENTS

| | | | |
|---|---|---|---|
| 3,576,099 | 4/1971 | Walton | 58/50 R |
| 3,613,351 | 10/1971 | Walton | 58/23 R |
| 3,701,249 | 10/1972 | Bergey et al. | 58/50 R |
| 3,722,206 | 3/1973 | Bergey | 58/50 R |
| 3,760,582 | 9/1973 | Thiess et al. | 58/50 R |
| 3,760,584 | 9/1973 | Dargent | 58/50 R |
| 3,827,043 | 7/1974 | Maezawa | 58/50 R |
| 3,971,012 | 7/1976 | Morokawa et al. | 58/50 R |
| 4,092,638 | 5/1978 | Ripley | 58/50 R |

FOREIGN PATENT DOCUMENTS

| | | | |
|---|---|---|---|
| 1388127 | 3/1975 | United Kingdom | 58/50 R |
| 1442630 | 7/1976 | United Kingdom | 58/50 R |
| 1475413 | 6/1977 | United Kingdom | 58/50 R |

OTHER PUBLICATIONS

"Die Uhren und Schmuck", 1977, issue 8, pp. 34–35.

*Primary Examiner*—Vit W. Miska

*Attorney, Agent, or Firm*—Eyre, Mann, Lucas & Just

[57] ABSTRACT

Balanced digital time displays for presenting readouts in which (A) minute digits are positioned to trail hour digits during the first half of each hour and are then reversed to lead the hour digits during the second half of each hour, (B) the minute digits are driven to count minutes up to a peak value of 30 during the first half of each hour and then down to 00 with advancement of the hour digits to the next hour, during the second half of each hour, (C) second digits are positioned perpendicularly below the minute digits and (D) the second digits are driven to count seconds up to a peak value of 30 during the first half of each minute and then down to 00 during the second half of each minute. Such balanced displays provide immediately comprehendible readouts of time in both gross and precise contexts.

45 Claims, 11 Drawing Figures

OSC.
FREQ. DIVIDER
÷10
÷3
÷2
÷6
DECODER DRIVER

BALANCED DIGITAL TIME DISPLAYS

CROSS-REFERENCE TO RELATED APPLICATION

This application is a continuation-in-part of copending application Ser. No. 861,115, filed Dec. 16, 1977, now abandoned.

BACKGROUND OF THE INVENTION

1. Field of the Invention

This invention relates to timekeeping and, more particularly, to the use of digital time displays for general purpose timekeeping. The term "general purpose", as applied to digital time displays or digital timekeeping in context of the ensuing description, is used qualitatively to refer to the general timekeeping needs and practices of ordinary individuals occupied with their usual activities on a day-to-day basis, as distinguished from specialized time monitoring procedures used in particular circumstances, e.g., scientific experiments, computer operations, games and sporting events, etc.

2. Description of the Prior Art

General purpose digital time displays have been available to consumers over the past several years in a variety of products, e.g. wrist watches, clocks, clock-radios and numerous other articles. Such displays generally consist of a horizontal array of hour and minute digits separated by a colon, with the hour digits positioned to the left and the minute digits to the right, and with the minute digits being driven to count values up from 01 to 59 and, one minute later, to reset to 00, with a simultaneous increase in the value of the hour digits to that of the next hour. On occasion, with liquid crystal type displays, second digits are also provided, positioned to the right of the minute digits and also driven to count seconds up from 01 to 59, with resetting to 00 one second later, when the value of the minute digits is increased to the next minute. In other instances, such as with light emitting diode type displays, switching is employed to display second digits alone, counted as described above but without a simultaneous display of hour and minute digits.

Although such displays and products have been commercially successful, they have not displaced completely, or even to a major extent, their analog counterparts and competition. The latter are based upon the conventional twelve-hour dial face with hour, minute, and optionally second, hands rotating through 360° to indicate the time by the progressive positions of the hands relative to spaced markings applied along the dial perimeter. Many consumers, both prospective and actual, have found currently available general purpose digital time displays to be inconvenient, awkward, difficult to use or otherwise objectionable in comparison to analog time displays, and often because of poorly perceived or definable reasons.

Although it appears to be commonly accepted that conventional general purpose digital time displays excel in informing the user of the present time at the moment of the readout, it is also recognized that burdensome mental calculations are required to translate that readout in the viewer's mind into grosser time contexts, e.g. the position of the precise time relative to a larger interval such as an hour of half hour, or how much time remains before the next hour or half hour, or how much time has passed or is to pass in relation to the occurrence of other exact times as previous or future references. Thus, conventional general purpose digital time displays suffer from the basic drawback of isolating the present time without also providing rapidly comprehendible indications of the larger time contexts which individuals ordinarily rely upon to carry out their general activities and for which analog time displays are far superior because of the graphic overall picture of gross time presented by their hand positions relative to the dial face markings. These and like problems in the use of conventional digital time displays have been described specifically, for example, in a survey reported in the November 1976 issue of Comsumer Reports (Vol. 41, No. 11), a well known consumer products evaluation journal.

SUMMARY OF THE INVENTION

The present invention provides balanced digital time display systems and methods which avoid or alleviate the above-described disadvantages of conventional general purpose digital time displays. The invention is based upon a recognition of the fundamental character of analog time displays as superior for informing the viewer of gross time contexts because of the symmetry or balance that is inherent in their geometries, together with the realization that substantial advantages and improvements can be achieved if analogous balance is incorporated in digital time displays.

More particularly, in analog time displays the centrally located 12 o-clock mark at the top of the dial is a most important reference point because when the minute hand is near or over it, the viewer is informed by that fact alone of the approximate or exact end of one hour and the start of another hour, the passage of successive hours having marked significance in a gross time sense to the daily activities of most individuals. Likewise, when the minute hand is over the 6 o-clock mark at the bottom of the dial, the viewer knows immediately that half of the existing hour has passed and the second half remains, which is another gross time context having frequently important significance to the progress and timing or ordinary daily activities.

If the 12 o-clock and 6 o-clock points are now visualized as vertically compressed together to distort the analog dial face into an elongated horizontal background on which digital time is to be displayed, then positioning of the minute or hour digits at the center of the background provides a central reference point which is in balance with the equal areas flanking its opposite sides, just as a line joining the 12 o-clock and 6 o-clock points on the analog dial face divides it into equal semicircles representing the first and second halves of each hour.

During the first half of each hour, an analog minute hand is in the first semi-circle to the right of the 12 o-clock - 6 o-clock axis, and it crosses over into the second semi-circle to the left of that axis during the second half of each hour. Analogous balance and comprehendibility of such gross time contexts are achieved from digital time displays, in accordance with the present invention, e.g. by positioning the minute digits to the right of the hour digits during the first half of each hour and then reversing the arrangement to position the minute digits to the left of the hour digits during the second half of each hour whereby, in a readout from left to right, the minute digits trail the hour digits during the first half hour and precede the hour digits during the second half hour.

In reading analog time displays, the viewer ordinarily focuses upon the shortest distance between the minute hand and the all important 12 o-clock reference point, thus observing and mentally noting how far the hand has moved away from that point during the first half hour, and how close the hand has moved toward that point during the second half hour. Analogous balance, distance minimization and comprehendibility of such gross time contexts are achieved from digital time displays, in accordance with the present invention, by counting relatively trailing minutes up, e.g. from 01 to a peak value of 30, during the first half of each hour, and then increasing the hour digit display to the next hour while counting relatively leading minutes down from that peak value, e.g. 29 to 00, during the remaining half hour.

In its broadest aspects, then, the invention provides a display of the digit value of the present hour in a relatively leading or preceding readout position and of increasing digit values of minutes in a relatively trailing position at the commencement of each hour, followed by an increase of the hour digit value to that of the next hour in a relatively trailing readout position accompanied by decreasing digit values of minutes in a relatively preceding or leading readout position during a subsequent portion of the same hour and before the actual commencement of the next hour. This basic principle may be combined with the refinement of simultaneously displaying increasing digit values of seconds during a first portion of each minute and thereafter displaying decreasing digit values of seconds during a subsequent portion of the same minute to inform the viewer at a glance of the positional relationship of any exact time readout to the larger time contexts of each current minute, half hour and hour.

The foregoing principles of balance and immediate comprehendibility of both gross and exact time contexts from digital time displays are further refined in preferred embodiments of the invention. Accordingly, other features and advantages of the invention will be evident from the ensuing detailed description, taken in connection with the accompanying drawings.

DESCRIPTION OF THE PREFERRED EMBODIMENTS

Figure 1:
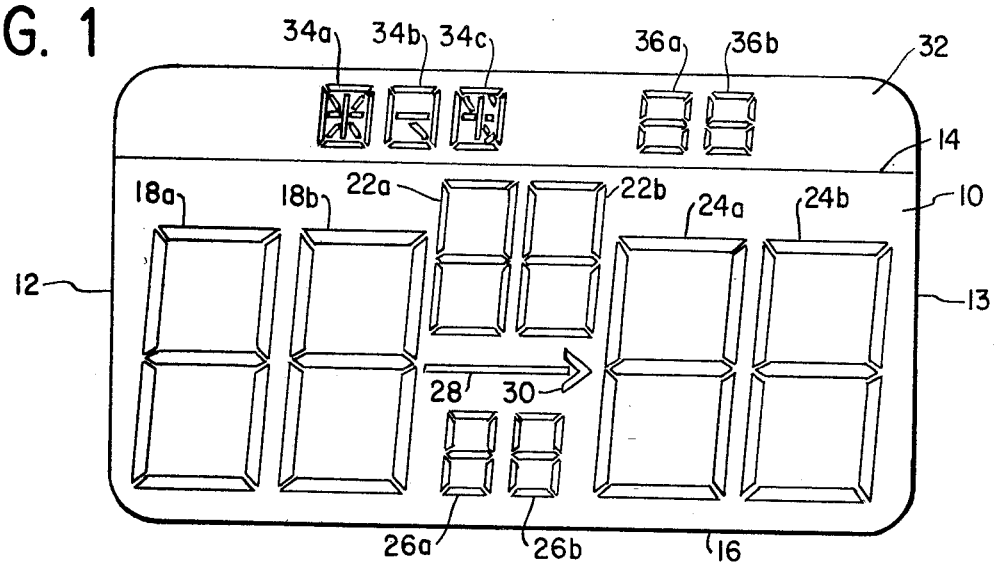
FIG. 1 is a front view of energizable digital display elements arranged for balanced digital time displays in accordance with one preferred embodiment of the invention.

Referring to FIG. 1, illustrated there is a horizontally oriented background 10, bordered by the opposite side perimeters 12 and 13, and upper and lower perimeters 14 and 16. Arranged on this background are four pairs of energizable display elements 18*a*, and *b*, 22*a* and *b*, 24*a* and *b*, and 26*a* and *b*. These pairs consist of two 7-segment arrays of light emitting diode or liquid crystal display elements, each array being selectively energizable to display each of the digits from 0 to 9, thereby presenting in each array pair the tens and ones units of digital time values to the viewer.

The display element pairs 18*a* and *b* and 24*a* and *b* are of the same overall size and positioned at the left and right sides of the background 10. The display element pair 22*a* and *b* is of smaller overall size than the pairs 18*a* and *b* and 24*a* and *b*, and is positioned at the center of the background 10, between the pairs 18*a* and *b* and 24*a* and *b*. The display element pair 26*a* and *b* is the smallest in overall size compared to pairs 18*a* and *b*, 22*a* and *b* and 24*a* and *b*, and is also positioned at the center of the background 10, perpendicularly below pair 22*a* and *b*. An energizable horizontal line display element 28 is positioned between the centrally located display element pairs 22*a* and *b* and 26*a* and *b*. An energizable arrowhead display element 30 is positioned adjacent the right end of the horizontal line display element 28, pointing toward the element pair 24*a* and *b*.

Above the upper perimeter 14 is another horizontal background 32, substantially narrower than background 10, and on which is arranged a set of three groups of energizable display elements 34*a*, *b* and *c*, which may be selectively energized in conventional manner to display the first three letters of the days of the week. To the right of the elements 34*a*, *b* and *c* is another pair of 7-segment arrays of energizable display elements 36*a* and *b*, similar to the pairs 18*a* and *b*, 22*a* and *b* and 26*a* and *b*, which may be selectively energized to display the date of each day of the month in conventional manner. The element pair 36*a* and *b* is the smallest in overall size, compared to the pairs 18*a* and *b*, 22*a* and *b*, 24*a* and *b* and 26*a* and *b*.

Figure 2:
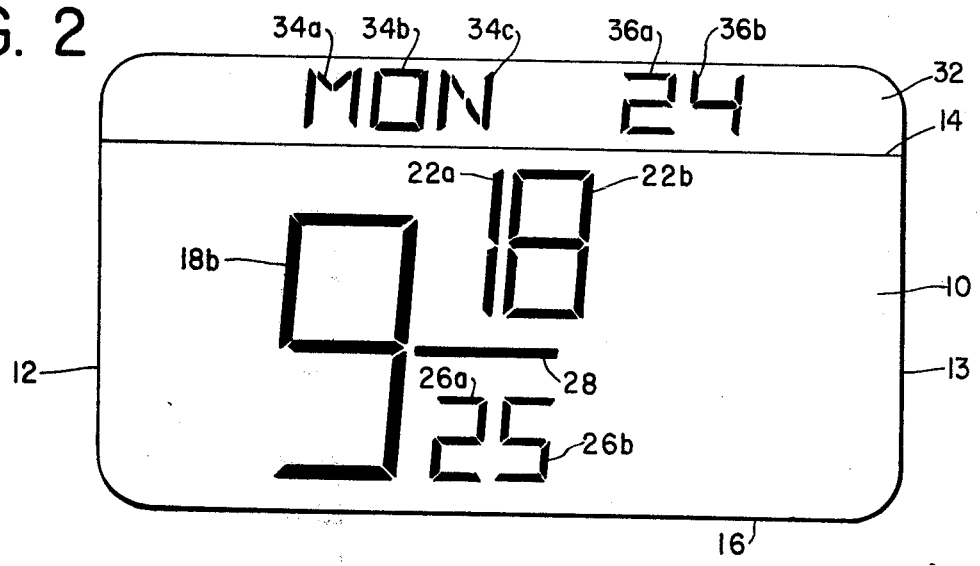
FIG. 2 is a view similar to FIG. 1 showing a representative balanced digital time display during the first half of an hour.

Referring to FIG. 2, illustrated there is energization of (A) the array of elements 18*b* to display the digit "9", (B) the pair of elements 22*a* and *b* to display the digits "18", (C) the pair of elements 26*a* and *b* to display the digits "25", and (D) the horizontal line element 23 between the displayed digits "18" and "25", all of the other energizable elements within the background 10 of FIG. 1 being de-energized and thereby blanked. Accordingly, the FIG. 2 display informs the viewer that the present time is eighteen minutes after the ninth hour (A.M. or P.M.), and more precisely, that twenty-five seconds of that eighteenth minute have elapsed.

This instantaneous time can be readily comprehended without confusion or ambiguity in view of several factors. First, the sizes of the digits are graduated, hours being largest, minutes intermediate, and seconds smallest in overall size, thus presenting appearances having direct correspondence with the magnitudes of the time intervals being displayed by the respective digits. Secondly, there is no interruption presented to the viewer's vision between the leading hour digits 18*b* and the trailing minute digits 22*a* and *b*, whereas the latter are purposely separated by the horizontal line 28 from the second digits 26*a* and *b*. These geometries are maintained at all times in the balanced digital time displays of the invention, thereby retaining visually recognizable features in the sizes and positions of all the digits despite the reversals of the relative leading and trailing positions of the hour and minute digits during respective first and second halves of each hour. Also, in accordance with the invention, the second digits 26*a* and *b* are being driven to count up to a peak value of 30 and if the display is read for more than one second, this increasing (or decreasing after value 30) progression in the values of the second digits will be immediately apparent, further distinguishing such values from those of the adjacent hour and minute digits. The end result is that the format of the display itself promotes immediate recognition and understanding of the time values and significances of the respective digits.

In addition, the display elements 34*a, b* and *c*, and 36*a*, and *b*, in the upper narrower background 32, have been energized to inform the viewer of the day of the week "MON" and the date of the day of the month ∓24", thus providing along with the time all the other information generally useful for carrying out ordinary daily activities.

Figure 3:
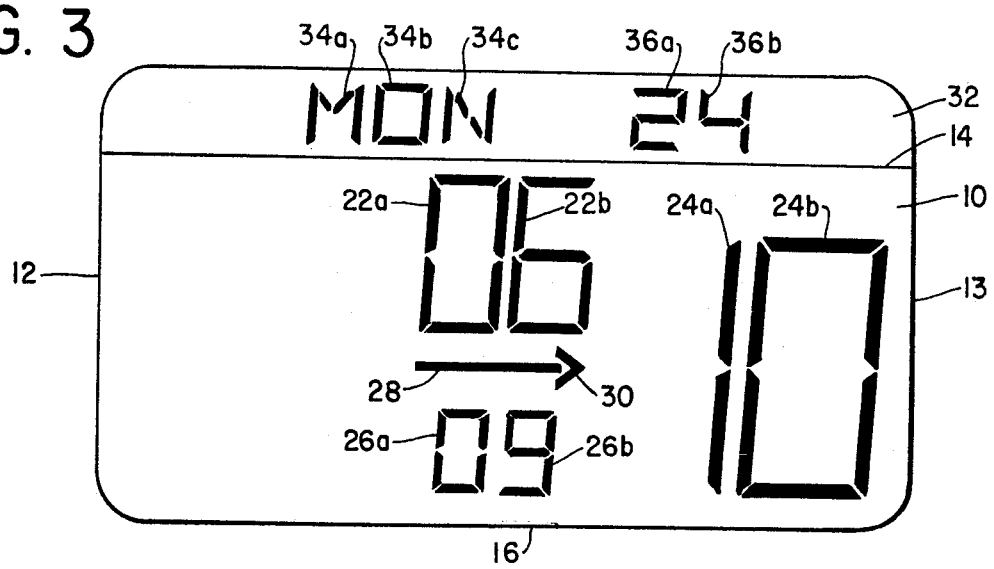
FIG. 3. is a view similar to FIG. 2 showing a representative balanced digital time display during the second half of the same hour.

Referring to FIG. 3, illustrated there is the display arrangement of FIG. 1 energized in such manner that (A) the pair of elements 24*a* and *b* display the digits "10", (B) the pair of elements 22*a* and *b* display the digits "06", (C) the pair of elements 26*a* and *b* display the digits "09", (D) the horizontal line element 28 and the arrowhead element 30 display an arrow pointing to the right, all other display elements within the background 10 of FIG. 1 being blanked. Thus, reading the display from left to right, the viewer is informed immediately that the time is six minutes before the next approaching hour (10 o-clock), and even more precisely, that there are six minutes and nine seconds remaining before that hour. The arrow formed by elements 28 and 30 emphasizes the significance in the readout of the leading position of the minute digits relative to the hour digits, viz. that the minute values on display are those which remain and are decreasing before the arrival of the next hour. Furthermore, this reversal of position immediately distinguishes the display from the opposite mode shown in FIG. 2, so that there can be no confusion or ambiguity in reading the two modes during the first and second halves of each hour.

Figure 4:
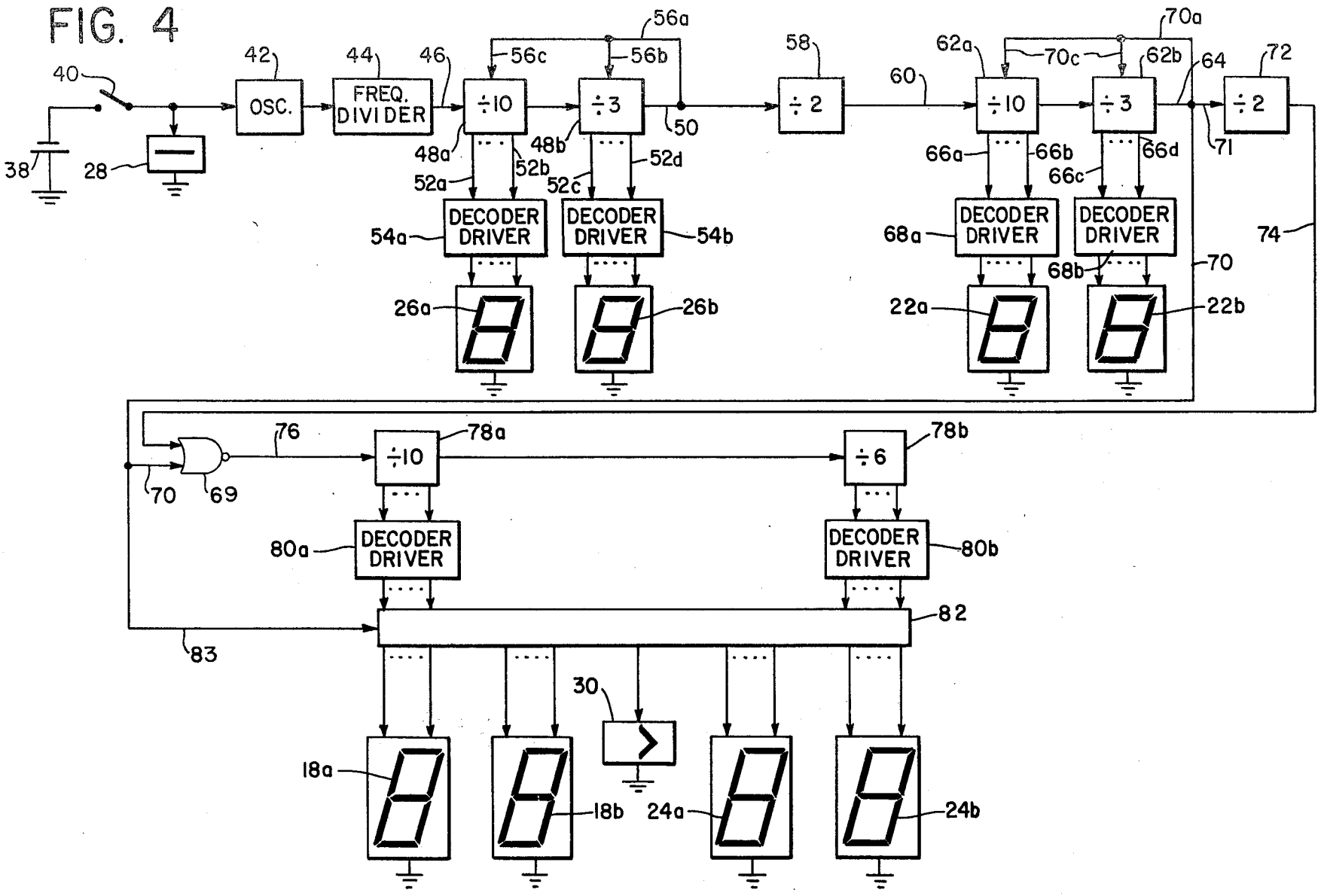
FIG. 4 is a block diagram of an electronic circuit suitable for energizing the display elements of FIG. 1 in accordance with FIGS. 2 and 3.

Referring to FIG. 4, illustrated there is a circuit for energizing the display elements shown in FIG. 1 in accordance with the representative modes shown in FIGS. 2 and 3 for first and second half hours, respectively. The circuit is powered by an energy source such as a battery 38, connected through a manual switch 40 which, upon actuation, provides power for continuous energization of the horizontal line element 28 at all times during operation of the circuit. Switch 40 also connects the power source to a high frequency solid state oscillator 42, which oscillates at a high enough frequency to provide an accurate base time signal, e.g. $2^{15}$, or 32,768, Hz. The oscillator output is fed to a multi-stage frequency divider 44 which successively divides the oscillator frequency down to 1 Hz (i.e. one cycle per second), such pulses appearing as an output on line 46.

This 1 Hz signal is fed into a solid state up-down counter having internal stage 48*a* operating as modulo 10 and stage 48*b* operating as modulo 3, the two together dividing the 1 Hz signal input as a scale of thirty divider to produce a pulse every 30 seconds as an output on line 50. As the counter 48*a* and *b* counts the 1 Hz pulses inputted on line 46, each count is outputted by the counter stages as a binary code or binary coded decimal signal over lines 52*a, b, c* and *d* to decoder-driver units 54*a* and *b*, which translate the binary signals into discriminating energization signal patterns for selectively energizing the 7-segment display elements 26*a* and *b* to display digits corresponding to the count up, from 01 to 30.

At this point (and after each successive thirty second interval), an output pulse appears on line 50, which is returned over lines 56*a, b* and *c* to counter stages 48*a* and 48*b* to reverse the count direction, whereby the next thirty pulses inputted from line 46 will be counted down. As a result, the same binary code or binary coded decimal signals which were generated by the counter 48*a* and *b* during the up count again will be outputted to the decoder-drivers 54*a* and *b*, this time in an opposite progression, whereby the 7-segments arrays of display elements 26*a* and *b* are selectively energized by the decoder-drivers to display the corresponding digits from 29 to 00. At that time, another pulse appears on line 50 which is fed back through lines 56*a, b* and *c* again to reverse the count direction, whereby the next thirty pulses will be counted up to repeat the previous cycle. Thus, it can be seen that the display elements 26*a* and *b* will be driven to count up for thirty seconds and then down for thirty seconds, and corresponding balanced progressions of second digit values will be displayed to the viewer throughout the time that the circuit is energized.

The pulses appearing every thirty seconds on line 50 are also inputted to a frequency divider 58, which divides the frequency in half and, as a result, outputs a pulse on line 60 every sixty seconds, or once a minute. These pulses are transmitted to another up-down counter 62*a* and *b*, similar to counter 48*a* and *b*, having a modulo 10 stage 62*a* and a modulo 3 steps 62*b*, which together divide the one per minute frequency of the input pulses as a scale of thirty divider to produce an output pulse on line 64 once every thirty minutes, or every half hour.

The input pulses from line 60 are counted and outputted by the counter 62*a* and *b* over lines 66*a, b, c* and *d* to the decoder-drivers 68*a* and *b*, and the output pulses on line 64 are returned through lines 70*a* and *c* to control the count direction of counter 62*a* and *b* every thirty minutes, in the same manner as previously described for the counter stages 48*a* and *b* and decoder-drivers 54*a* and *b* associated with the second digits displays 26*a* and *b*, the essential difference being the lower frequency at which the operation is carried out for the elements 22*a* and *b* displaying the minute digits. Accordingly, without having to repeat all the previous details, it will be evident that the counter 62*a* and *b*, the decoder-drivers 68*a* and *b* and the respective input and output pulses associated with them drive the display elements 22*a* and *b* in a manner to display digits which count minutes up from 01 to 30 and then down to 00, and that this cycle repeats throughout the time that the circuit is in operation. Also, the count is synchronized with the seconds count being displayed by elements 26*a* and *b*, whereby the balanced progression of the second digits from 01 to 30 and back to 00 coincides with the period of each minute being displayed by elements 22*a* and *b*.

The pulse appearing every thirty minutes on line 64 is inputted by line 70 to a NAND gate 69, and by line 71 to a frequency divider 72. The latter divides the frequency of the input pulses by two to produce an output pulse once every hour, which output pulse also is inputted by line 74 to NAND gate 69. Gate 69 produces an output pulse on line 76 whenever the once per thirty minute pulse alone is inputted by line 70, but does not conduct when both that pulse and the pulse appearing once per hour on line 74 are simultaneously inputted. As a result, gate 69 is synchronized with the minute and second digits being displayed by elements 22*a* and *b* and 26*a* and *b* to produce an output pulse on line 76 once every hour on the half hour, in coincidence with the peak value of 30 reached by the minutes display.

The output pulse from gate 69 is inputted to a two-stage counter 78*a* and *b* to increase the value of the counter output by one, this process being repeated incrementally over a 12-hour or 24-hour range of digit values (whichever may be desired) with each successive pulse appearing on line 76 at each hour on the half hour. This counter output value is fed as a binary code or binary coded decimal signal to decoder-drivers 80*a* and *b*, which translate the signal into discriminating signal patterns for selectively energizing either the elements 18*a* and *b* or the elements 24*a* and *b* to display the corresponding hour digits over the 12- or 24-hour cycle.

The outputs of the decoder-drivers 80*a* and *b* are connected to the display elements 18*a* and *b* and 24*a* and *b* through alternative parallel paths provided by a switching network 82. When the peak 30-minute count is reached by display elements 22*a* and *b*, the resulting pulse appearing on line 70 for transmission to gate 69 is also fed by line 83 to the switches in network 82, whereby simultaneously with the next counted minute (value "29"), the decoder-driver outputs are routed to the display elements 24*a* and *b*, together with an increase in the value of the hour digits by one hour, and with the arrowhead element 30 also connected to the power source 38 for continuous display. Accordingly, the display switches from the FIG. 2 mode to the FIG. 3 mode.

After another thirty minutes, a pulse again appears on line 83 to operate the switches in network 82 and route the outputs of the decoder-drivers 80*a* and *b* to display elements 18*a* and *b*, at the same time de-energizing and blanking elements 24*a* and *b* and arrowhead element 30. This change occurs without any increase in the value of the hour digits, since a simultaneous pulse appears on line 74 to render NAND gate 60 non-conducting, thereby preventing any incrementing of counter 78*a* and *b*. Incrementing will occur again only after the next thirty minutes, when both a switching pulse will appear on line 83 and a counter incrementing pulse on line 70, with the latter passing gate 69, in view of absence of a pulse on line 74, to operate the counter 78*a* and *b*.

Figure 4A:
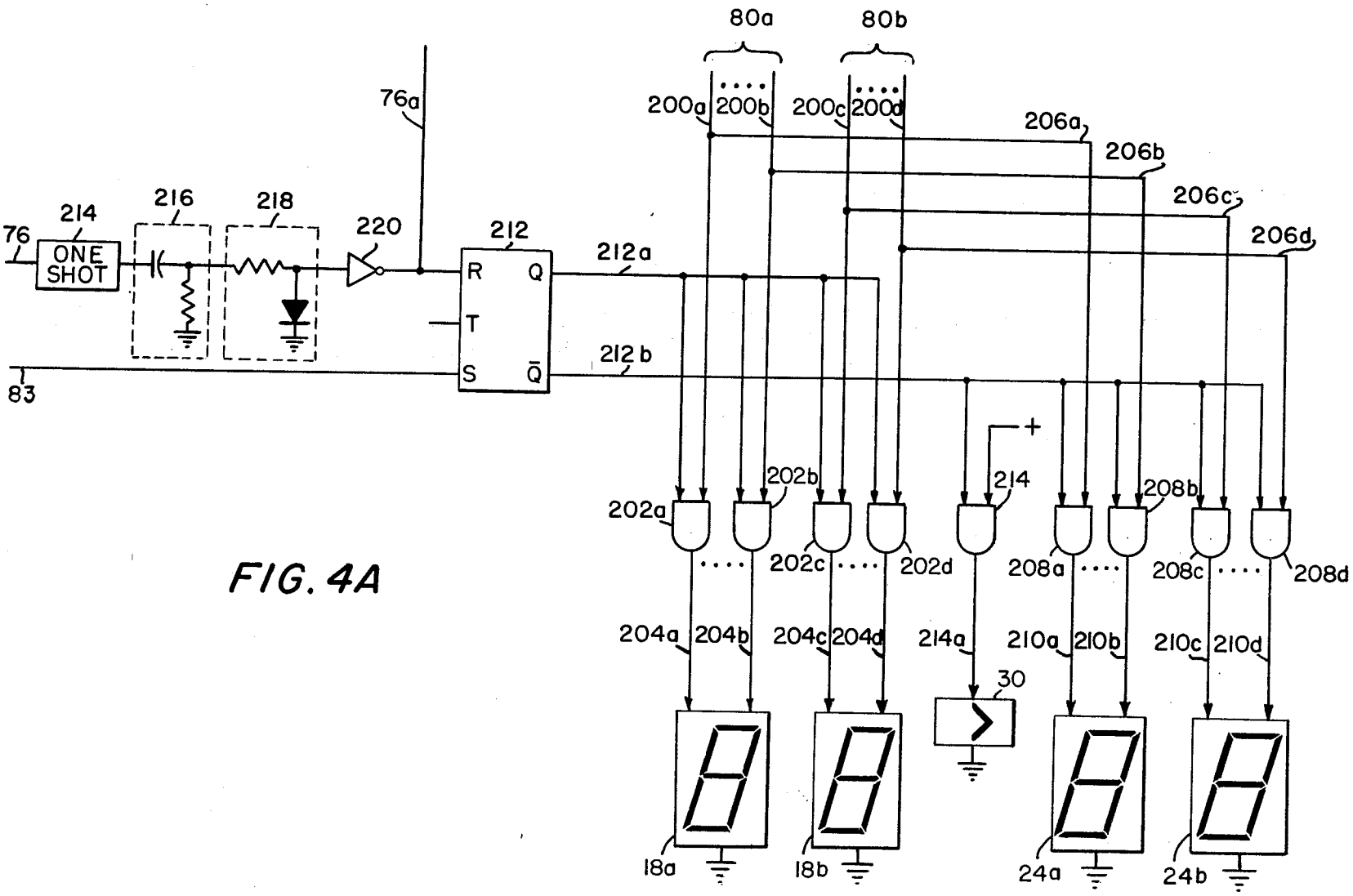
FIG. 4A is a diagram of an exemplary circuit which may be used in FIG. 4.

Referring to FIG. 4A, there is illustrated an exemplary circuit which may be used to perform the functions described for the switching network 82 in FIG. 4. The outputs of the decoder-drivers 80*a* and *b* from FIG. 4 are connected by lines 200*a, b, c* and *d* to AND gates 202*a, b, c* and *d*, there being one line and gate for each separate output. The outputs of these gates, in turn, are connected by lines 204*a, b, c* and *d* to the 7-segment arrays of hour elements 18*a* and *b*, which are in the leading position relative to the minute display elements 22*a* and *b*. The outputs of the decoder-drivers 80*a* and *b* are also connected in parallel by lines 206*a, b, c* and *d* to another series of AND gates 208*a, b, c* and *d*. The outputs of these gates are connected by lines 210*a, b, c* and *d* to the relatively trailing 7-segment hour arrays 24*a* and *b*.

An RST flip-flop 212 has its Q output connected by line 212*a* to the gates 202*a, b, c* and *d*. The Q output of flip-flop 212 is connected by line 212*b* to the gates 208*a, b, c* and *d*, as well as to AND gate 214. Source voltage is also connected as an input to gate 214, the output of which is connected by line 214*a* to the arrowhead display element 30.

Line 83 from FIG. 4 is connected to the "S" input of flip-flop 212. Line 76, instead of connecting to counter 78*a* and *b*, connects gate 69 in FIG. 4 to a one-shot multivibrator 214 which, upon being triggered by a pulse on line 76, generates a square wave of one minute duration. This output is differentiated by the differentiator circuit 216 to provide leading positive and trailing negative spikes, the leading one of which is clipped by the diode clipper 218 and the trailing one of which is inverted by inverter 220 to provide a positive pulse, one minute after the appearance of a pulse on line 76, at the "R" input of flip-flop 212 and on line 76*a* which is connected to the counter 78*a* and *b*.

In operation of the FIG. 4A network, a pulse appears every thirty minutes on line 83 which sets flip-flop 212 so that the Q output is high and Q at reference potential. This enables gates 202*a, b, c* and *d* to route the outputs of the decoder-drivers 80*a* and *b* to the leading hour array elements 18*a* and *b* while the minute elements 22*a* and *b* are displaying increasing minute values. At thirty minutes after each hour, a pulse also appears on line 76 which triggers the delay line comprising one-shot 214 and circuit elements 216, 218 and 220 to provide a pulse one minute later on line 76*a* and at the R input of flip-flop 212. This resets flip-flop 212 so that now Q is high and Q at reference potential. As a result, gates 202*a, b, c* and *d* are disabled, gates 208*a, b, c* and *d* are enabled, and the decoder-driver outputs 80*a* and *b* are routed to the trailing hour array elements 24*a* and *b*, together with energization of arrowhead element 30 and incrementing of counter 78*a* and *b*, at thirty-one minutes after the hour, when the minute elements 22*a* and *b* display the first decreasing value "29" below the peak thirty minute value. Twenty-nine minutes later the next pulse appears on line 83 to set flip-flop 212 again to Q high and Q at reference potential. This re-routes the decoder-driver outputs 80*a* and *b* to the leading hour arrays 18*a* and *b* at the time that the minute elements 22*a* and *b* have reached value "00".

The foregoing cycling repeats throughout operation of the circuits shown in FIGS. 4 and 4A. The "T" input of flip-flop 212 is available for operation by manual control to provide source voltage at such input and thereby change the state of the flip-flop to route the decoder-driver outputs to the proper set of hour array elements, as may be required after circuit interruption. Obviously, other components or networks which perform the equivalent of the switching functions carried out by the FIG. 4A circuit may be used in place thereof.

Thus, referring to FIGS. 2 and 3, the operation of the circuits shown in FIGS. 4 and 4A will present time displays having the format of FIG. 2 for the first thirty minutes of each hour, after which the display will change, with an increase of one in the value of the hour digits, to the format of FIG. 3 for the next thirty minutes of each hour. At that point, the hour digits 24 will be reversed in position again to lead the minutes-seconds display, as in FIG. 2, without an increase in the value of the hour digits until the next thirty minutes have elapsed. Such cycling will continue throughout the operation of the circuit.

Figure 5:
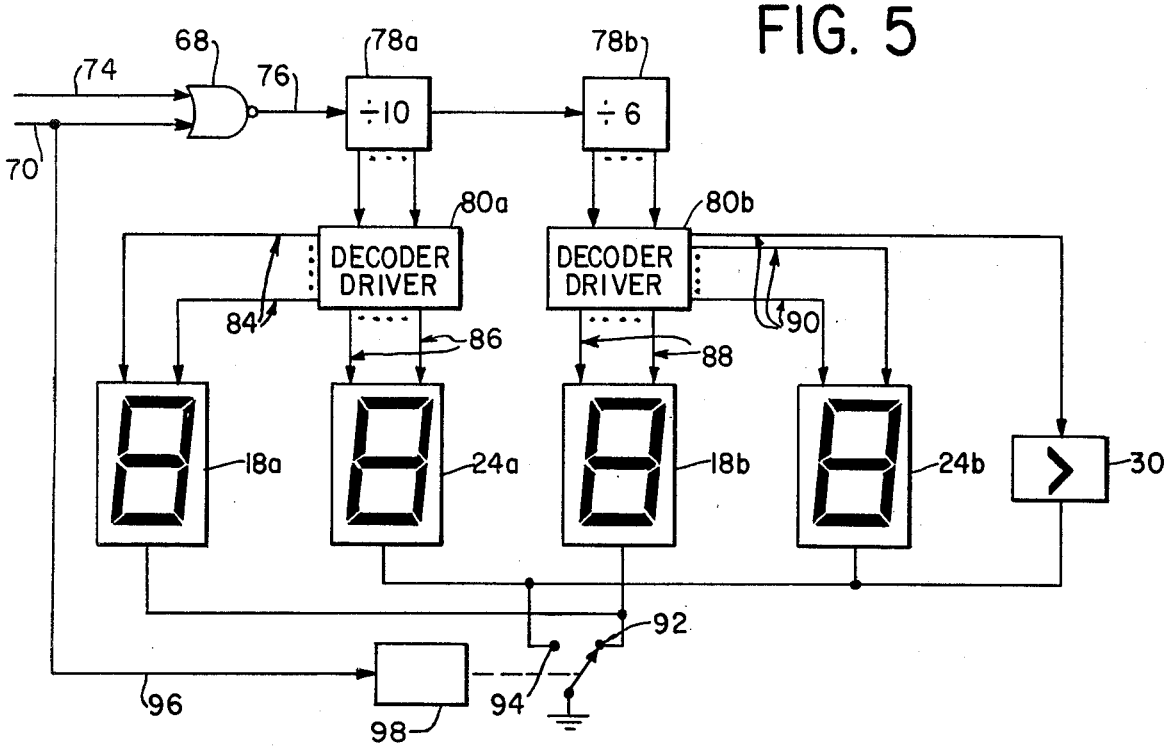
FIG. 5 is a diagram of a modification of the circuit of FIG. 4.

Referring to FIG. 5, illustrated there is a modification in the hours stage of the circuit shown in FIG. 4. The control and operation of the gate 69, counter 78*a* and *b* and decoder-drivers 80*a* and *b* in FIG. 5 are the same as described for FIG. 4 up to the outputs of the decoder-drivers. However, instead of routing the outputs of the decoder-drivers alternatively to the display elements 18*a* and *b*, and 24*a* and *b* and 30, by interposed switching (network 82 of FIGS. 4 and 4A), the decoder-driver outputs in FIG. 5 are applied simultaneously through fixed parallel paths to common counterparts in alternative sets of hour digit display elements. More particularly, the output of decoder-driver 80*a*, which controls the tens units of the hour digits display, is connected through lines 84 to the display elements 18*a* and through lines 86 to the counterpart display elements 24*a*, one or the other of these element sets being used to display the value of the tens units of the hour digits during successive half hour periods in operation of the circuit. Similarly, the output of decoder-driver 80*b* is connected in parallel through lines 88 to the display elements 18*b* and through lines 90 to the display elements 24*b* and arrowhead display element 30, one or the other of the elements 18*b* and 24*b* being used to display the value of the ones units of the hour digits during operation of the circuit.

The display elements 18*a* and *b* are connected to a common point 92 for grounding, and the display elements 24*a* and *b* and arrowhead element 30 are connected to another common point 94 for grounding. The pulse appearing every thirty minutes on line 70 is also fed by line 96 to a dual position switch 98 which alternately connects points 92 and 94 to ground. When the switch is in the position shown in FIG. 5, only the commonly grounded display elements 18*a* and *b* can be energized by the outputs of the decoder-drivers 80*a* and *b* to display hour digits, in accordance with the mode shown in FIG. 2. When the switch 98 is operated by a thirty minute pulse inputted by lines 70 and 96, the switch shifts from the ground point 92 to point 94, thereby connecting the commonly grounded elements 24*a* and *b* and arrowhead element 30 to ground. Therefore, only those elements can be energized by the decoder-drivers 80*a* and *b* to display hour digits and the arrowhead 30, in accordance with the mode shown in FIG. 3. Since the modification shown in FIG. 5 simplifies the switching otherwise used in FIG. 4, it may be preferred in particular applications of the circuit. Also, although grounding switch 98 has been illustrated in FIG. 5 as a mechanical switch to facilitate explanation and understanding of its functions, it will be understood that in actual implementation it may be an electronic switch which performs the equivalent functions.

The circuits of FIGS. 4, 4A and 5 utilize switching interposed between the decoder-drivers and the 7-segment digit display elements or ground, which is feasible with light emitting diodes or line powered displays. With liquid crystal displays, however, to avoid problems of incomplete de-energization of the respective display elements due to the high impedances involved, it will be understood that the switch positions will be transposed either to between the decoders and the drivers or before the decoder-driver combinations. Also, the circuits will be associated in actual use with switches and circuit means for effecting gross changes in the displayed digit values in order to permit setting of the displays or resetting, e.g. when traveling across different time zones, or moving the hour ahead or back at different seasons. Since the means for achieving such setting adjustments are well known and not part of this invention, they have not been specifically described herein. Similarly, the circuits and means for presenting calendar displays such as the day of the week and the date of the day of the month shown in FIGS. 2 and 3 are well known, not part of this invention and, therefore, not specifically described.

Figure 6:
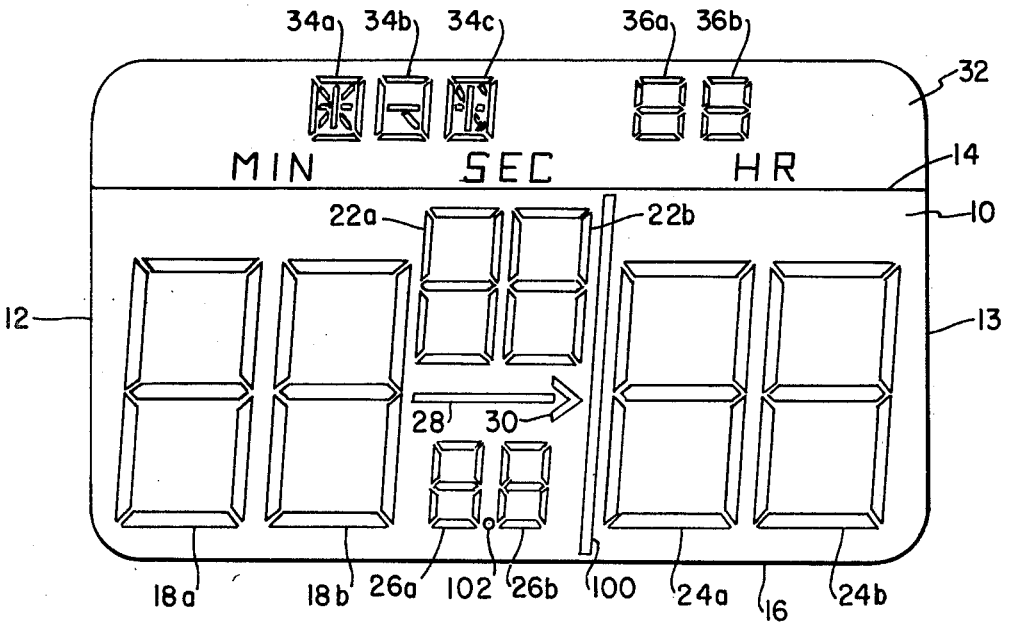
FIG. 6 is a front view of a modification of the arrangement of FIG. 1 for presenting balanced digital time displays as well as digital chronograph functions in accordance with another preferred embodiment of the invention.

Referring to FIG. 6, illustrated there is a modification of the arrangement of display elements of FIG. 1. The differences are the addition in the background 10 of an energizable perpendicular line display element 100, joining upper and lower perimeters 14 and 16 of the background 10, and a dot display element 102 between the tens and ones units of the display elements 26*a* and *b*. Also, in background 32, above upper perimeter 14, are energizable display elements presenting the abbreviations "MIN", "SEC" and "HR" for minutes, seconds and hours, these indicia being aligned perpendicularly over the display element pairs 18*a* and *b*, 22*a* and *b* and 24*a* and *b*, respectively.

The foregoing additional display elements are normally maintained de-energized and blanked while the FIG. 6 arrangement is used to present balanced digital time displays in accordance with the representative modes illustrated in FIGS. 2 and 3. In addition, the FIG. 6 arrangement can be switched to the display mode illustrated in FIG. 7, by de-energization and blanking of all of the other display elements shown in FIG. 6. This presents a digital chronograph display which can be used for timing events in specialized ways, e.g stop watch, time-in time-out accumulate, or lap accumulate functions, which per se are known and which are useful in particular circumstances, e.g. sports, scientific or engineering activities, etc.

Figure 7:
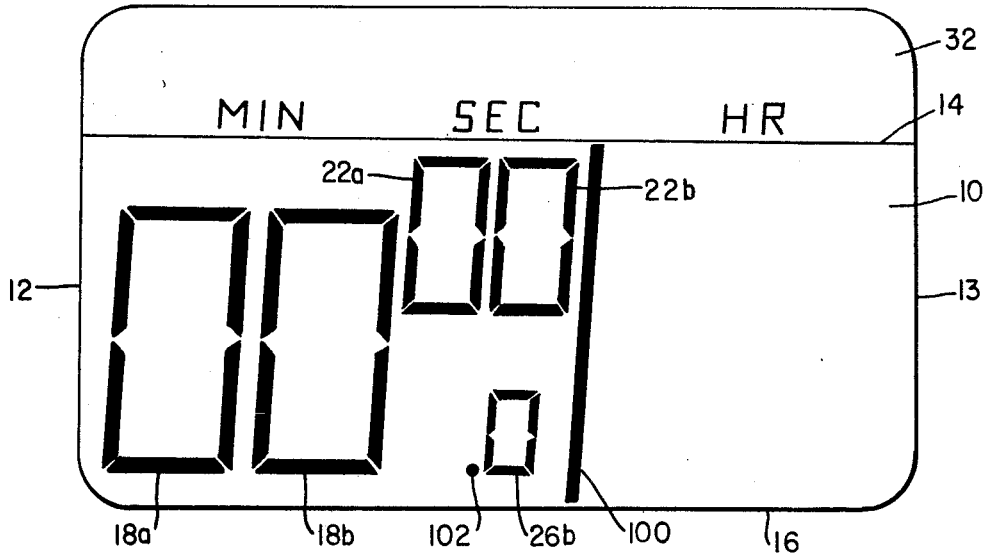
FIG. 7 is a similar view showing the arrangement of FIG. 6 energized for chronograph functions.

The FIG. 7 chronograph display can be energized to accumulate time by counting tenths of seconds from 0 to 9, seconds from 00 to 59, and minutes from 00 to 59. The circuits for driving the display in that manner are well known and will not be described here since they are not part of this invention. However, certain advantages are achieved by the FIGS. 6 and 7 displays which provide improvements over conventional digital chronographs.

First, when the display is switched to the FIG. 7 mode, it is immediately recognizable as a chronograph display which cannot be confused with the other displays used for general purpose timekeeping, as is evident from comparison of FIG. 7 with FIGS. 2 and 3. Also, the graduated overall sizes of the digits in FIG. 7 provide analogous facility in the chronograph readout, as was previously described in connection with FIGS. 2 and 3, since the appearance of the digit sizes is also in direct correspondence with the magnitudes of the minute, second and tenth of second values being displayed. Inasmuch as most chronograph-timed events are completed in less than an hour, zero values of the hour digits display elements 24*a* and *b* are purposely blanked as superfluous when switching to the FIG. 7 chronograph mode, thereby avoiding distraction of the viewer's attention from the minute, second and tenth of second digit values which are invariably required in all chronograph timing. But in the event such timing continues beyond an hour or more, the accumulated hour values then can be displayed by suitable energization of the display elements 24*a* and *b*. Perpendicular line 100, in that case, separates such accumulated hours from the visibly on-going chronograph timing displayed to the left of the line, thereby rendering the total readout immediately comprehendible with minimum likelihood of confusion or ambiguity.

Accordingly, with only a few added display elements shown in FIG. 6, the balanced digital display arrangement shown in FIG. 1 may be enhanced with the capability and versatility of also presenting the alternative chronograph display shown in FIG. 7, to achieve both substantially improved general purpose timekeeping and chronograph timing where it is desired to provide such an option to the user.

Figure 8:
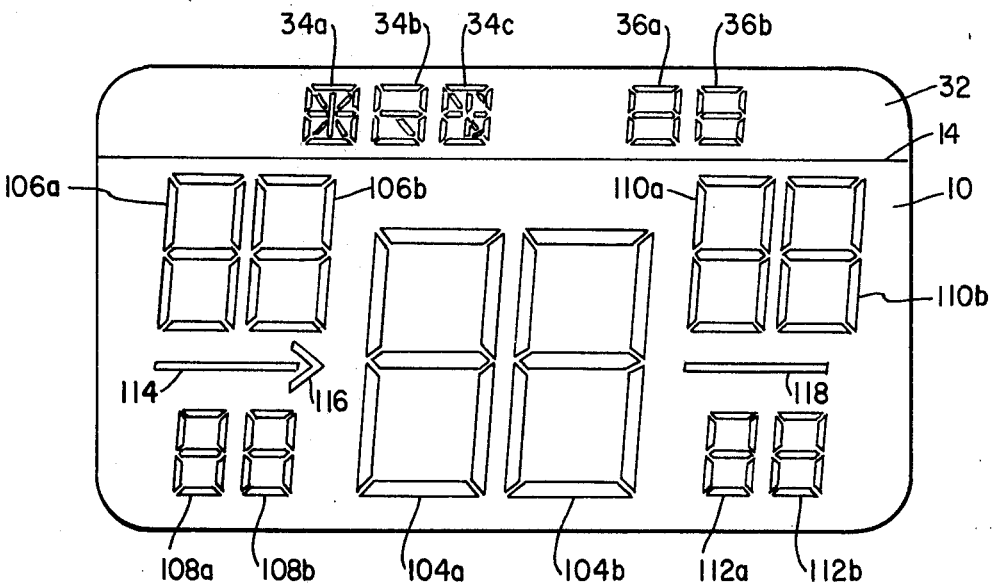
FIG. 8 is a view similar to FIG. 1 showing another preferred embodiment of the invention.

Referring to FIG. 8, illustrated there is another arrangement of balanced digital display elements which differs from the arrangement of FIG. 1 in several respects. A major difference is that in FIG. 1, the perpendicularly aligned minute and second display elements 22*a* and *b* and 26*a* and *b* remain fixed in position at the center of the background 10, and their respective trailing and leading positions relative to the hour digits are achieved by alternately changing the position of the hour digits from the left to the right sides (and vice versa) of the background 10 (see FIGS. 2 and 3). This has the advantage of blanking the area to the left, occupied by the hour digits during the first half hour, and thereafter transposing the viewer's line of vision to the right side when the hour digits are both displayed there and also increased in value to the next hour. This transposition serves to reinforce in the viewer's mind the fact that there has been an upward increment in the hour, signified by its simultaneous advance in position along the horizontal time axis represented by the left-to-right readout direction.

In the embodiment of FIG. 8, the foregoing transposition is not used. Instead, a single pair of 7-segment arrays of display elements 104*a* and *b* are positioned at the center of background 10 for use in displaying the hour digits. Flanking both sides of these elements are duplicate sets of perpendicularly aligned minute and second display elements 106*a* and *b* and 108*a* and *b* on the left, and 110*a* and *b* and 112*a* and *b* on the right. The left one of these duplicate minute-second display element sets includes right-pointing horizontal line and arrowhead display elements 114 and 116 separating the minute elements from the second elements, whereas the counterpart elements of the right set are separated by only a horizontal display element 118.

In using the arrangement shown in FIG. 8, the element pair 104*a* and *b* is energized during the first half of each hour to display the value of that hour, together with the minute-second digits set 110*a* and *b*, 112*a* and *b* and 118 on the right to count minutes up to 30, and seconds up from 01 to 30 and back to 00 during each minute. Thereafter, this set is de-energized, the hour digits are increased in value by one, and the minute-second set 106*a* and *b*, 108*a* and *b*, 114 and 116 on the left is energized to count minutes down to 00, with seconds being counted as before. Accordingly, it will be evident that in the circuit of FIG. 4, the seconds and minutes stages will be modified to incorporate the above-described duplicate sets of minute and second 7-segment arrays, as well as the separating horizontal elements 114, 116 and 118. Also, the switching shown in the hours stage of FIG. 4 will be eliminated and substituted in an analogous manner in the minutes and seconds stages to alternate every third minutes between the duplicate minute-second sets to provide the above-described displays over the course of each hour.

The advantage of the FIG. 8 embodiment compared with that of FIGS. 1, 2 and 3 is that the hour digits display 104*a* and *b* remains fixed in position at the center of background 10 at all times, the minute digits (together with the second digits) undergoing transpositions from right to left (and vice versa) to trail and lead the hour digits during the first and second halves of each hour. This arrangement, therefore, simulates more closely an analogy with the 12 o-clock position of a conventional analog dial face where the completion and start of each hour is marked by the minute hand being over that fixed position, and then moving to the right of that position during the first half hour and to the left during the second half hour. The disadvantage of the FIG. 8 arrangement is that it requires more energizable display elements and switching of more of those elements than FIGS. 1, 2 and 3. However, this trade-off may be considered acceptable in particular implementations of the balanced digital time display system shown in FIG. 8, in order to attain its above-described advantages.

Figure 9:
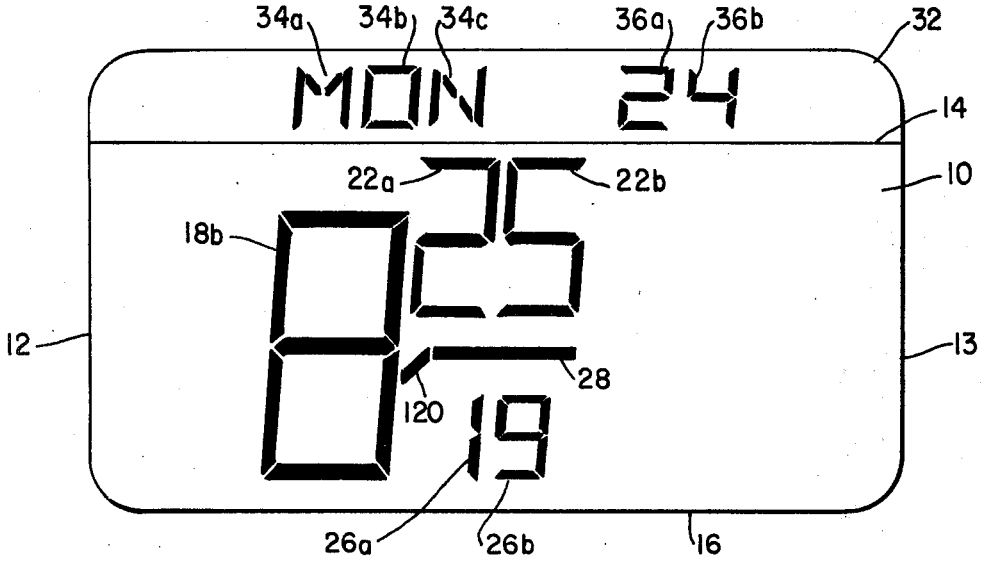
FIG. 9 is a view similar to FIG. 2 showing still another preferred embodiment of the invention in a representative first half hour display mode.
Figure 10:
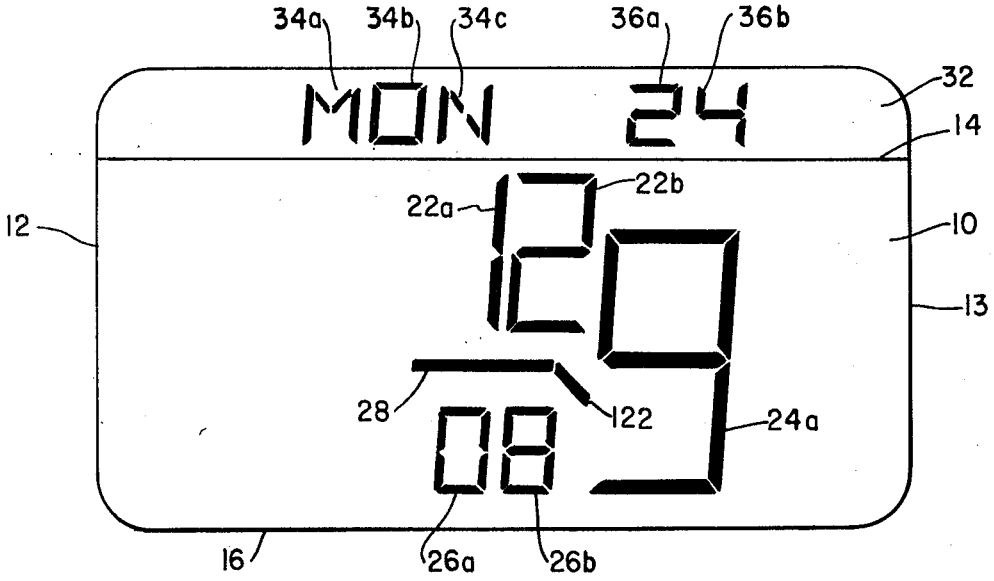
FIG. 10 is a similar view showing the FIG. 9 embodiment in a representative second half hour diplay mode.

Referring to FIGS. 9 and 10, illustrated there are modifications of the embodiment shown in FIGS. 1, 2 and 3. More particularly, in FIG. 9 a short energizable line display element 120 is added, sloping upwardly from left to right to nearly join the left end of the horizontal line display element 28. In FIG. 10, a similar short line element 122 is added, sloping downwardly from left to right and extending from the right end of the horizontal line 28, in place of the arrowhead element 30 shown in FIG. 3. These sloping line elements are added to the hours stages of the circuits shown in FIGS. 4 and 5 to be energized during first and second halves of each hour, together with the respective hour digits on the left and right sides of display, as shown in FIGS. 9 and 10.

The combination of the line elements 120 and 28 in FIG. 9 not only directs the viewer's vision from left to right to read the leading hour and trailing minute digits, but also provides an upward component in the line of sight to emphasize that the minutes are increasing in value. The combination of line elements 28 and 122 in FIG. 10 operates in a converse manner, leading the line of sight both from left to right and downwardly to reinforce in the viewer's mind that the relatively leading minutes are diminishing in value and approaching closer to the displayed trailing next hour. Furthermore, these opposite modes display mirror image-like symmetry and balance which readily distinguishes one from the other and promotes maximum comprehendibility of the positional relationship of any present time readout to its grosser half hour and hour contexts.

The invention has now been described in terms of its fundamental operating principles and specific preferred embodiments thereof. One of the principal advantages of the disclosed balanced digital time displays is their capability of informing the viewer at a glance, and without having to read the values of any displayed digits, whether the present time is within the first or second half of the existing hour. Since the formats of the display modes geometrically distinguish these respective half hour intervals, such information is immediately comprehendible from the display and enables the viewer much more readily to appreciate the significance and relationship of the present time defined by the hour-minute digit values to the larger half hour and hour intervals.

A similar advantage is achieved with regard to the interval of each minute by counting and displaying seconds up from 01 to a peak value 30 and back down to 00, in synchronism with the total minute interval. This enables the viewer, by mere observation of the upward or downward progression in the direction of the second digits values, to understand immediately whether the present time is within the first or second half of the current minute. By reading the specific instantaneous value of the seconds digits, the viewer also is able readily to determine precisely when the current minute will reach or has passed its half way point, or will come to its end.

Other important advantages of the balanced digital time displays of the present invention are the substantial reduction of digit values and the overall system simplification which are presented to the viewer. Since minutes and seconds are counted only up to a peak value of 30, the range of digit values required is reduced to half that of conventional displays (i.e. 00–30 vs. 00–59). Combined with the fact that such narrower range is traversed in equal increasing and decreasing paths during each minute and hour, the net effect is manifest simplification of the system derived from fewer and smaller numbers displayed in balanced progressions which visibly distinguish between equal halves of each hour and are more compatible with the general timekeeping needs of individuals engaged in day-to-day activities.

The foregoing translates into particularly tangible benefits when having to make determinations of future time intervals which approach or bridge across the next hour from a specific present time. Referring, for example, to FIG. 10, a viewer wishing to make an appointment forty minutes later than the so-displayed present time need only subtract the displayed minutes value from the forwardly-projected forty-minute period to determine that the time of the appointment will be twenty-eight minutes past 9 o-clock ($40-12=28$). Or, if the viewer is requested to meet another person at twenty-five minutes past 9 o-clock, a simple addition will determine that he has thirty-seven minutes in which to keep the appointment ($12+25=37$). Such simplification alleviates the burdensome mental calculations which individuals have heretofore considered objectionable in the use of conventional digital time displays.

It will be evident to those skilled in the art that the illustrative preferred embodiments described above may be modified in a variety of ways without departing from the fundamental principles of the invention. For example, while all of the embodiments display both minutes and seconds, the seconds display can be eliminated where that degree of precision is not required or desired, and the remaining hour and minute displays will provide all of the other advantages and benefits previously described. Also, all of the illustrative embodiments operate to leave the background vacant at the right or the left of the centrally positioned minute-second or hour digits, as the displays are switched at half hour intervals to establish the alternative trailing/-leading readout positions of hour and minute digits. This not only serves to reinforce in the viewer's mind the time significances and distinctions between the alternative displays, but also provides the constructional advantage of permitting all of the necessary display elements to be positioned in a single common plane, thereby avoiding any necessity for superimposed multiple display planes and switching between such planes to obtain the required alternative displays. Where the latter is not a disadvantage, however, the displays of the illustrative preferred embodiments can be reduced in their horizontal spread by positioning the alternative display modes in separate superimposed centered planes and switching between such planes in known manner, thereby eliminating the appearance of vacant areas in the background and filling it substantially completely with the digit displays at all times.

Similarly, conventional switching like that used with light emitting diode displays can be adopted, if desired, to selectively energize shared common display elements to establish the alternative displays conforming to the present invention. This will reduce the actual number of required elements and can eliminate duplicative hour or minute elements to provide cost savings which may be important in specific implementations.

Finally, although the illustrative embodiments have been described in specific terms of electrically energizable display elements, such as the light emitting diode or liquid crystal displays currently being used in conventional digital time displays, it is evident that the invention may also be implemented with mechanical display elements such as rotating wheels presenting incremental digit values on their circumferential peripheries for viewing through open or shuttered apertures or windows. Generally, all forms of display elements which are operable to display digits in formats, value sequences and readout positions conforming to the principles of the invention may be used to achieve the advantages and improvements which have been described above.

Accordingly, it will be understood that the invention is not limited to the illustrative preferred embodiments but encompasses the subject matter delineated by the appended claims and all equivalents thereof.

The following is claimed:

1. A balanced digital time display system which comprises:

(a) hour elements operable for displaying hour digit values, (b) minute elements operable for displaying minute digit values, (c) means for operating the hour elements to display the digit value of a present hour, (d) means for operating the minute elements to display increasing digit values of minutes in a readout position which trails the displayed present hour, (e) means for increasing the displayed present hour to the digit value of the next hour before the commencement of the next hour, and (f) means for operating the minute elements to display decreasing digit values of minutes in a readout position which precedes the displayed next hour before the commencement of the next hour.

2. A system as in claim 1 which further includes second elements operable for displaying second digit values, means for operating the second element to display increasing digit values of seconds during a portion of a minute, and means for operating the second elements to display decreasing digit values of seconds during a subsequent portion of the same minute.

3. A balanced digital time display system which comprises:

(a) hour elements operable for displaying hour digit values,
(b) minute elements operable for displaying minute digit values,
(c) means for operating the hour elements to display the digit value of the present hour during the first half of each hour,
(d) means for operating the minute elements to display increasing digit values of minutes in a readout position which trails the displayed present hour during the first half of each hour,
(e) means for increasing the displayed present hour to the value of the next hour during the second half of each hour, and
(f) means for operating the minute elements to display decreasing digit values of minutes in a readout position which precedes the displayed next hour during the second half of each hour.

4. A system as in claim 3 in which the overall size of the displayed hour digits is greater than the overall size of the displayed minute digits.

5. A system as in claim 3 which further includes a line element operable for displaying a line below the displayed minute digits, and means for operating the line element at all times during operation of the system.

6. A system as in claim 5 which further includes an arrowhead element operable for displaying an arrowhead in a readout position adjacent the end of the displayed line nearest the displayed next hour and pointing toward the latter, and means for operating the arrowhead element during the second half of each hour.

7. A system as in claim 5 which further includes a second line element operable for displaying a line of shorter length than and sloping upwardly toward and in a readout position preceding an adjacent end of the line on display below the displayed minute digits, a third line element operable for displaying another line of shorter length than and sloping downwardly from and in a readout position trailing the adjacent opposite end of the line on display below the displayed minute digits, means for operating the upwardly sloping line element during the first half of each hour, and means for operating the downwardly sloping line element during the second half of each hour.

8. A system as in claim 3 in which the minute digit values are increased up to a peak value of thirty and decreased to zero value during the respective first and second halves of each hour.

9. A system as in claim 3 which further includes second elements operable for displaying second digit values, means for operating the second elements to display increasing digit values of seconds during the first half of each minute, and means for operating the second elements to display decreasing digit values of seconds during the second half of each minute.

10. A system as in claim 9 in which the second digit values are increased up to a peak value of thirty and decreased to zero value during the respective first and second halves of each minute.

11. A system as in claim 10 in which the displayed seconds are located in a readout position below the displayed minutes, and which further includes a line element operable for displaying a line between the displayed minute digits and second digits, and means for operating the line element at all times during operation of the system.

12. A system as in claim 11 which further includes an arrowhead element operable for displaying an arrowhead in a readout position adjacent the end of the displayed line nearest the displayed next hour and pointing toward the latter, and means for operating the arrowhead element during the second half of each hour.

13. A system as in claim 3 which further includes a second line element operable for displaying a line of shorter length than and sloping upwardly toward and in a readout position preceding an adjacent end of the line on display between the displayed minute and second digits, a third line element operable for displaying another line of shorter length than and sloping downwardly from and in a readout position trailing the adjacent opposite end of the line on display between the displayed minute and second digits, means for operating the upwardly sloping line element during the first half of each hour, and means for operating the downwardly sloping line element during the second half of each hour.

14. A system as in claim 13 in which the displayed upwardly and downwardly sloping lines are equal in length.

15. A balanced digital time display system which comprises:
(a) a display background having upper, lower and opposite left and right side perimeters,
(b) hour elements energizable for displaying hour digit values within the background,
(c) minute elements energizable for displaying minute digit values within the background,
(d) means for energizing the hour elements to display the digit value of the present hour during the first half of each hour,
(e) means for energizing the minute elements to display increasing digit values of minutes from 01 to 30 in a readout position which trails the displayed present hour during the first half of each hour,
(f) means for increasing the displayed present hour to the digit value of the next hour during the second half of each hour, and
(g) means for energizing the minute elements to display decreasing digit values of minutes from 29 to 00 in a readout position which precedes said displayed next hour during the second half of each hour.

16. A system as in claim 15 in which the specified readout positions are based upon a readout from the left side perimeter to the opposite right side perimeter of the background.

17. A system as in claim 16 in which the overall size of the displayed hour digits is greater than the overall size of the displayed minute digits.

18. A system as in claim 17 which further includes a line element energizable for displaying a line below the displayed minute digits, and means for energizing the line element at all times during operation of the system.

19. A system as in claim 18 which further includes second elements energizable for displaying second digit values perpendicularly below the displayed minute digits and the line thereunder, means for energizing the second elements to display increasing digit values of seconds from 01 to 30 during the first half of each minute, means for energizing the second elements to display decreasing digit values of seconds from 29 to 00 during the second half of each minute, the overall size of the displayed second digits being smaller than the overall sizes of the displayed hour digits and minute digits.

20. A system as in claim 19 in which the perpendicularly aligned minute digits and second digits are maintained fixed in position at the center of the background, hour elements being energizable for display of present hour digits on the left side of the displayed minute-second digits to leave the background on the opposite right side blank during the first half of each hour, and hour elements being energizable for display of next hour digits on the right side of the displayed minutes-seconds digits to leave the background on the opposite left side blank during the second half of each hour.

21. A system as in claim 20 which further includes a perpendicular line element energizable for displaying a perpendicular line joining the upper and lower perimeters of the background and in a position between the minute-second elements and the hour elements energizable on the right side thereof, indicia elements energizable for displaying indicia signifying minutes, seconds and hours above the upper perimeter of the background and perpendicularly aligned over, respectively, the hour elements energizable on the left side of the minute-second elements, the minute-second elements and the hour elements energizable on the right side of the minute-second elements, a dot element energizable for displaying a dot between the tens and ones units of the second elements, and means for energizing the hour elements on the left side of the minute-second elements, the minute elements, the ones unit of the second elements, the indicia elements and the dot display element, while simultaneously blanking all other energizable elements within the background.

22. A system as in claim 19 in which the hour elements are maintained fixed in position at the center of the background, perpendicularly aligned minute-second elements being energizable for display of minute-second digits on the right side of the displayed present hour digits to leave the background on the opposite left side blank during the first half of each hour, and perpendicularly aligned minute-second elements being energizable for display of minute-second digits on the left side of the displayed next hour digits to leave the background on the opposite right side blank during the second half of each hour.

23. A system as in claim 18 which further includes an arrowhead element energizable for displaying an arrowhead adjacent the right end of the displayed line between the minute and second digits and pointing toward the displayed next hour, and means for energizing the arrowhead element during the second half of each hour.

24. A system as in claim 18 which further includes a second line element energizable for displaying a line of shorter length than and sloping upwardly toward and adjacent the left end of the displayed line between the minute and second digits, a third line element energizable for displaying another line of shorter length than and sloping downwardly from and adjacent the right side of the displayed line between the minute second digits, means for energizing the upwardly sloping line element during the first half of each hour, and means for energizing the downwardly sloping line element during the second half of each hour.

25. A balanced digital time display system which comprises a display of hour and minute digit values indicating the current time, second elements operable to display digit values of seconds, and means for operating the second elements to display increasing digit values of seconds during an initial portion of a minute and decreasing digit values of seconds during a subsequent portion of the same minute.

26. A system as in claim 25 which further includes means for operating the second elements to display increasing digit values of seconds from one to thirty during the first half of a minute and decreasing digit values of seconds from twenty-nine to zero during the second half of the same minute.

27. A system as in claim 25 or 26 in which the digit values of seconds are displayed in a position below the minute digits.

28. A balanced digital timekeeping method which comprises the steps of:

(a) displaying the digit value of a present hour, (b) displaying increasing digit values of minutes in a readout position trailing the displayed present hour, (c) increasing the displayed present hour to the digit value of the next hour before the commencement of the next hour, and (d) displaying decreasing digit values of minutes in a readout position preceding the displayed next hour before the commencement of the next hour.

29. A method as in claim 28 which further includes the steps of displaying increasing digit values of seconds during a portion of a minute, and displaying decreasing digit values of seconds during a subsequent portion of the same minute.

30. A balanced digital timekeeping method which comprises the steps of:

(a) displaying the digit value of the present hour during the first half of each hour, (b) displaying increasing digit values of minutes in a readout position trailing the displayed present hour during the first half of each hour, (c) increasing the displayed present hour to the digit value of the next hour during the second half of each hour, and (d) displaying decreasing digit values of minutes in a readout position preceding the displayed next hour during the second half of each hour.

31. A method as in claim 30 which further includes the step of maintaining the overall size of the displayed hour digits greater than the overall size of the displayed minute digits.

32. A method as in claim 30 which further includes the step of displaying a line below the displayed minute digits.

33. A method as in claim 32 which further includes the step of displaying during the second half of each hour an arrowhead adjacent the end of the displayed line nearest the displayed next hour and pointing toward the latter.

34. A method as in claim 33 which further includes the steps of displaying increasing digit values of minutes from 01 to 30 during the first half of each hour, displaying decreasing digit values of minutes from 29 to 00 during the second half of each hour, and maintaining the overall size of the displayed minute digits smaller than the overall size of the displayed hour digits.

35. A method as in claim 34 which further includes the steps of dislaying digit values of seconds below the displayed minute digits and the displayed line thereunder, increasing the second digit values from 01 to 30 during the first half of each minute, decreasing the second digit values from 29 to 00 during the second half of each minute, and maintaining the overall size of the displayed second digits smaller than the overall size of the displayed minute digits.

36. A method as in claim 32 which further includes the steps of displaying during the first half of each hour a second line of shorter length than and sloping upwardly toward and in a readout position leading the adjacent end of the line on display below the displayed minute digits, and displaying during the second half of each hour a third line of shorter length than and sloping downwardly from and in a readout position trailing the adjacent opposite end of the line on display below the displayed minute digits.

37. A method as in claim 36 which further includes the steps of displaying increasing digit values of minutes from 01 to 30 during the first half of each hour, displaying decreasing digit values of minutes from 29 to 00 during the second half of each hour, and maintaining the overall size of the displayed minute digits smaller than the overall size of the displayed hour digits.

38. A method as in claim 37 which further includes the steps of displaying digit values of seconds below the displayed minute digits and the displayed line thereunder, increasing the second digit values from 01 to 30 during the first half of each minute, decreasing the second digit values from 29 to 00 during the second half of each minute, and maintaining the overall size of the displayed second digits smaller than the overall size of the displayed minute digits.

39. A method as in claim 34 which further includes the steps of maintaining the displayed minute digits in a fixed display position throughout each hour, and alternately transposing the position of the displayed hour digits between opposite sides of the fixed minute digits to establish the specified relative readout positions of the one to the other during respective first and second halves of each hour.

40. A method as in claim 34 which further includes the steps of maintaining the displayed hour digits in a fixed display position throughout each hour, and alternately transposing the position of the displayed minute digits between opposite sides of the fixed hour digits to establish the specified relative readout positions of the one to the other during respective first and second halves of each hour.

41. A method as in claim 34 which further includes the step of establishing the specified relative readout positions on the basis of a left to right readout direction.

42. A method as in claim 36 which further includes the step of maintaining the upwardly and downwardly sloping lines equal in length.

43. A balanced digital timekeeping method which comprises displaying hour and minute digit values indicating the current time, and also displaying increasing digit values of seconds during one portion of a minute and decreasing values of seconds during a subsequent portion of the same minute.

44. A method as in claim 43 which further includes the steps of displaying increasing digit values of seconds from one to thirty during the first half of a minute and decreasing digit values of seconds from twenty-nine to zero during the second half of the same minute.

45. A method as in claim 43 or 44 which further includes the step of displaying the digit values of seconds in a position below the minute digits.

* * * * *

UNITED STATES PATENT AND TRADEMARK OFFICE

CERTIFICATE OF CORRECTION

PATENT NO. : 4,264,966
DATED : April 28, 1981
INVENTOR(S) : Berj A. Terzian

It is certified that error appears in the above-identified patent and that said Letters Patent are hereby corrected as shown below:

Column 1, line 65: Change "of" to --or--.

Column 2, line 42: Change "or" to --of--.

Column 5, line 27: Change "$\overline{+}$" to --"--.

Column 6, line 45: Change "steps" to --stage--.

Column 7, line 54: Change "60" to --69--.

Column 8, line 10: Change "Q" to --$\overline{Q}$--.

Column 8, line 31: Change "Q" in the second instance to --$\overline{Q}$--.

Column 8, line 40: Change "Q" to --$\overline{Q}$--.

Column 8, line 51: Change "Q" to --$\overline{Q}$--.

Column 12, line 5: Change "third" to --thirty--.

Column 13, line 9: Insert --of-- after "peak value".

Column 14, line 62: Change "element" to --elements--.

UNITED STATES PATENT AND TRADEMARK OFFICE

CERTIFICATE OF CORRECTION

PATENT NO. : 4,264,966

DATED : April 28, 1981

INVENTOR(S) : Berj A. Terzian

It is certified that error appears in the above-identified patent and that said Letters Patent are hereby corrected as shown below:

Column 15, line 13: Insert --digit-- after "the" in the first instance.

Column 16, line 46: Insert --direction-- after "readout" in the second instance.

Column 17, line 56: Insert --and-- after "minute".

Signed and Sealed this

*Twenty-eighth* Day of *July 1981*

[SEAL]

*Attest:*

GERALD J. MOSSINGHOFF

*Attesting Officer*

*Commissioner of Patents and Trademarks*